US009119464B2

(12) United States Patent
Huang et al.

(10) Patent No.: US 9,119,464 B2
(45) Date of Patent: Sep. 1, 2015

(54) BRUSH CLEANING SYSTEM

(75) Inventors: Fu-Ming Huang, Shengang Township (TW); Liang-Guang Chen, Hsinchu (TW); Han-Hsin Kuo, Tainan (TW); Chi-Ming Tsai, New Taipei (TW); He Hui Peng, Changhua (TW)

(73) Assignee: TAIWAN SEMICONDUCTOR MANUFACTURING COMPANY, LTD. (TW)

( * ) Notice: Subject to any disclaimer, the term of this patent is extended or adjusted under 35 U.S.C. 154(b) by 761 days.

(21) Appl. No.: 13/362,635

(22) Filed: Jan. 31, 2012

(65) Prior Publication Data

US 2013/0192634 A1 Aug. 1, 2013

(51) Int. Cl.

| | |
|---|---|
| ***B08B 3/00*** | (2006.01) |
| ***A46B 17/06*** | (2006.01) |
| ***B08B 1/00*** | (2006.01) |
| *A46B 15/00* | (2006.01) |

(52) U.S. Cl.
CPC ..... *A46B 17/06* (2013.01); *B08B 1/007* (2013.01); *A46B 15/0018* (2013.01)

(58) Field of Classification Search
None
See application file for complete search history.

(56) References Cited

U.S. PATENT DOCUMENTS

| | | | | |
|---|---|---|---|---|
| 3,225,377 | A * | 12/1965 | Winter et al. | 15/311 |
| 5,639,311 | A * | 6/1997 | Holley et al. | 134/6 |
| 2008/0302394 | A1 * | 12/2008 | Albrecht et al. | 134/32 |

* cited by examiner

*Primary Examiner* — Eric Golightly
(74) *Attorney, Agent, or Firm* — Lowe Hauptman & Ham, LLP

(57) ABSTRACT

A brush cleaning system comprising: a plate comprising at least one of silicon nitride ($Si_xN_y$) or silicon oxide ($Si_aO_b$), wherein the plate has a static charge on a surface thereof; and a machine configured to rotate a brush in contact with the static charged surface of the plate.

20 Claims, 3 Drawing Sheets

BRUSH CLEANING SYSTEM

BACKGROUND

After chemical and mechanical polishing (CMP) of a semiconductor device, debris and residual solution are removed using a brush typical made of polyvinyl alcohol (PVA). As the brush cleans the semiconductor device, the brush itself becomes dirty and requires cleaning. If the brush is not thoroughly cleaned, debris and residue will be transferred onto subsequent semiconductor devices.

A conventional technique for cleaning a brush uses a quartz plate. A machine (brings the brush into contact with the quartz plate and rotates the brush. This cleaning method relies solely on mechanical force to remove debris and residual solution from the brush. It was found that conventional technique removes approximately 100 particles per minute of cleaning. Over time as the number of particles builds up on the brush, the effectiveness of the brush decreases and the brush must be replaced.

BRIEF DESCRIPTION OF THE DRAWINGS

The present disclosure is best understood from the following detailed description when read with the accompanying figures. It is emphasized that, in accordance with standard practice in the industry various features may not be drawn to scale and are used for illustration purposes only. In fact, the dimensions of the various features in the drawings may be arbitrarily increase or reduced for clarity of discussion.

DETAILED DESCRIPTION

It is understood the following disclosure provides many different embodiments, or examples, for implementing different features. Specific examples of components and arrangements are described below to simplify the present disclosure. These are, of course, merely examples and are not intended to be limiting.

The particles transferred to the brush during cleaning of a semiconductor device include charged abrasive particles and organic particles. The charged abrasive particles include metal particles removed during the CMP process. The organic particles include residue solution used in the CMP process. The conventional arrangement utilizes only mechanical force to scrape these particles off the brush, causing damage to the brush and leaving behind many particles. Better cleaning would increase the useful life of the brush thereby decreasing production costs.

Figure 1:
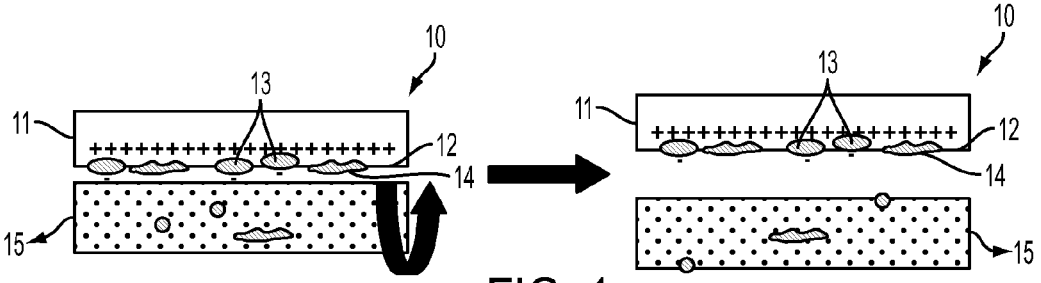
FIG. 1 is a side view of a diagram of an arrangement utilizing a positively charged plate to clean a brush according to some embodiments.
Figure 2:
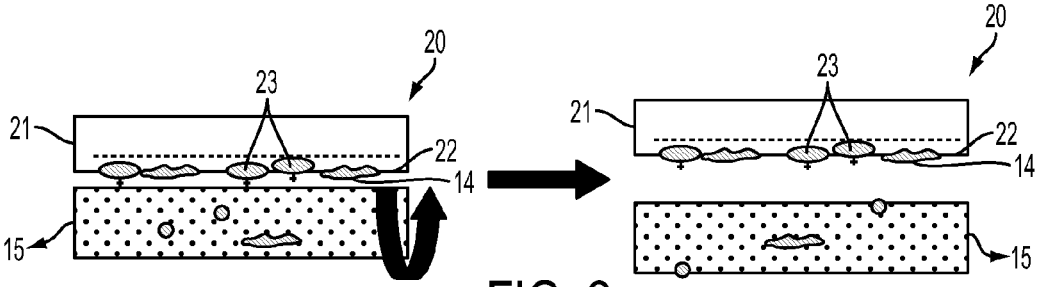
FIG. 2 is a side view of a diagram of an arrangement utilizing a negatively charged plate to clean a brush according to some embodiments.
Figure 3:
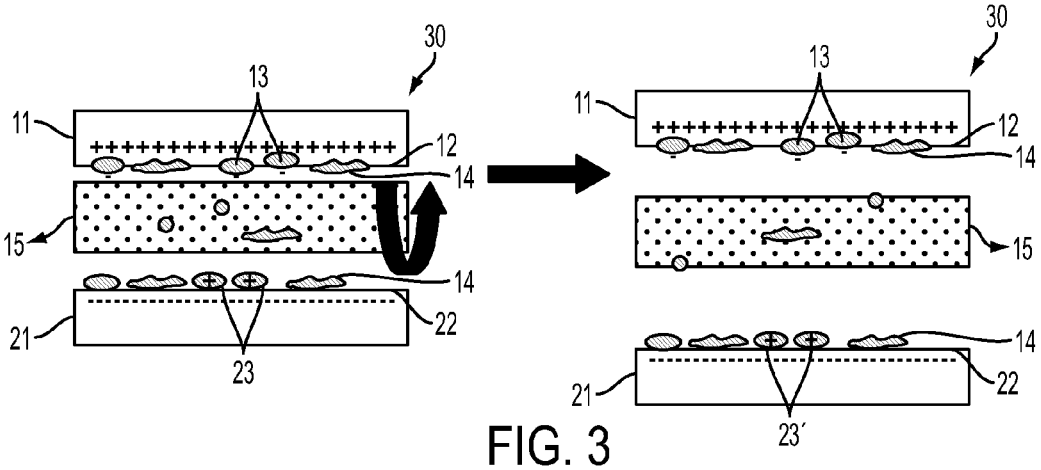
FIG. 3 is a side view of a diagram of an arrangement utilizing multiple charged plates to clean a brush according to some embodiments.

In the embodiments of FIGS. 1-3, the brush 15 has a cylindrical shape. In some embodiments, the brush 15 is an elongated cylinder. A cylindrical brush has protrusions extending perpendicular to the outer surface around the entire circumference. In some embodiments, the protrusions on the cylindrical brush are periodic. During the brush cleaning process, the cylindrical brush is rotated about its major axis, as shown in FIGS. 1-3. In other embodiments, the brush has a disk shape. A disk shaped brush has protrusions extending perpendicular to a single cleaning surface or elongated protrusions spiraling from the center point of the disk. In some embodiments, the protrusions on the disk shaped brush are periodic. During the brush cleaning process, the disk shaped brush is rotated about an axis perpendicular to the cleaning surface. In further embodiments, the brush has a square shape, an x-shape or another shape.

FIG. 1 shows an arrangement 10 in which brush 15 is cleaned by plate 11. A brush cleaning system 40 (FIG. 4) brings the brush 15 into contact with plate 11 and rotates brush 15. In an embodiment, the plate 11 comprises a silicon nitride ($Si_xN_y$, where x and y are integers). In other embodiments, the plate comprises a silicon oxide ($Si_aO_b$, where a and b are integers) or other materials. In some embodiments, x ranges from one to five. In some embodiments, y ranges from one to five. In some embodiments, a ranges from one to five. In some embodiments, b ranges from one to five. Plate 11 has a charge on surface 12. In the embodiment of FIG. 1, the surface charge is positive. In the embodiment of FIG. 1, the positive charge on surface 12 is induced by spraying the plate 11 with an acidic solution (i.e. pH below 7). In some embodiments, the acidic solution comprises critic acid, phosphoric acid or another suitable acidic solution. The positively charged surface 12 employs static electricity to attract negatively charged particles 13 to the plate surface 12. In addition, plate 11 uses mechanical force to remove neutral particles 14 and positively charged particles from brush 15.

FIG. 2 shows an arrangement 20 in which brush 15 is cleaned by plate 21. Brush cleaning system 40 (FIG. 4) brings the brush 15 into contact with plate 21 and rotates brush 15. In an embodiment, the plate 21 comprises a silicon nitride ($Si_xN_y$, where x and y are integers). In other embodiments, the plate comprises a silicon oxide ($Si_aO_b$, where a and b are integers) or other materials. Plate 21 has a charge on surface 22. In the embodiment of FIG. 2, the surface charge is negative. In the embodiment of FIG. 2, the negative charge on surface 22 is induced by spraying the plate 21 with a basic solution (i.e. pH above 7). In some embodiments, the basic solution comprises tetramethylammonium hydroxide (TMAH) or another suitable basic solution. The negatively charged surface 22 employs static electricity to attract positively charged particles 23 to the plate surface 22. In addition, plate 21 uses mechanical force to remove neutral particles 14 and negatively charged particles from brush 15.

FIG. 3 shows an arrangement 30 in which brush 15 is cleaned by plates 11 and 21. Brush cleaning system 40 (FIG. 4) brings the brush 15 into contact with plates 11 and 21 and rotates brush 15. In an embodiment, the plates 11 and 21 comprise a silicon nitride ($Si_xN_y$, where x and y are integers). In other embodiments, the plates comprise a silicon oxide ($Si_aO_b$, where a and b are integers) or other materials. In some embodiments, x ranges from one to five. In some embodiments, y ranges from one to five. In some embodiments, a ranges from one to five. In some embodiments, b ranges from one to five. Plate 11 can be the same material as plate 21 or a different material. In the embodiment of FIG. 3, plate 11 has a positive charge on surface 12 to attract negatively charged particles 13, and plate 21 has a negative charge on the surface 22 to attract positively charged particles 23. The charge on surface 12 is induced by spraying plate 11 with an acidic solution. The charge on surface 22 is induced by spraying plate 21 with a basic solution. In the embodiment of FIG. 3, brush 15 is cleaned simultaneously by plates 11 and 21. In other embodiments, brush 15 is cleaned separately by plates 11 and 21.

Figure 4:
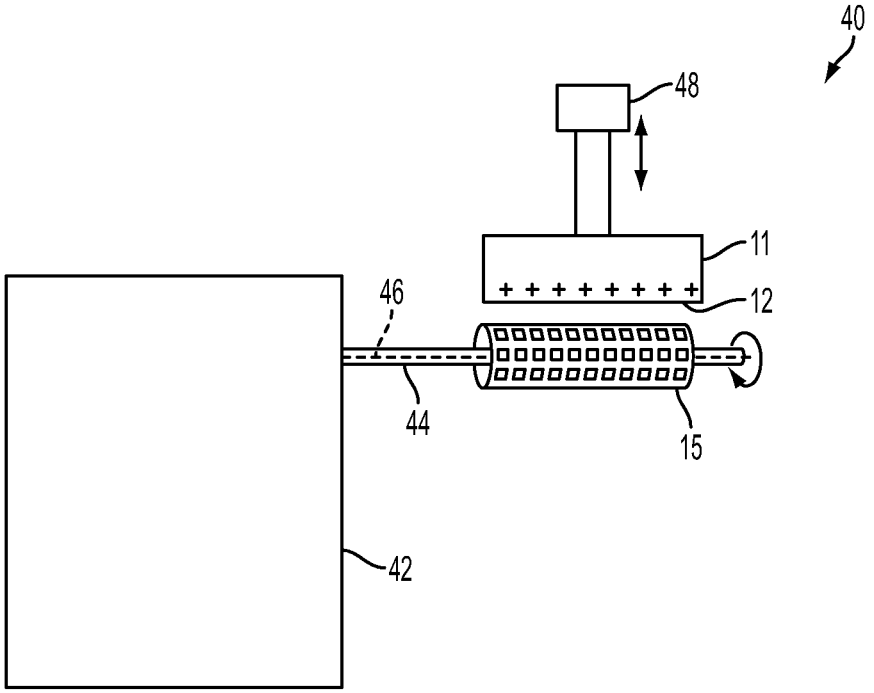
FIG. 4 is a side view of a diagram of a cleaning system, according to one or more embodiments.

FIG. 4 shows brush cleaning system 40 including a base structure 42 and a shaft 44 connected to base structure 42. Brush cleaning system 40 also includes brush 15 and plate 11, as well as an actuator 48 configured to adjust a vertical position of plate 51. Base structure 42 is configured to rotate shaft 44 about a longitudinal axis 46 thereof. In some embodiments, base structure 42 includes a mechanical motor, a piezoelectric rotary device, or other suitable rotation device.

Shaft 44 is configured to pass through a hollow center of brush 15. In some embodiments, shaft 44 includes a threaded end which engages complimentary threads attached to brush 15. Brush 15 is configured to attach to shaft 44, such that brush 15 rotates as shaft 44 rotates.

Actuator 48 is configured to translate plate 51 to come into contact with brush 15 while brush 15 is rotating to remove charged particles 13 or 23 and neutral particles 14. Following time duration ample to remove a sufficient number of charged particles 13 and neutral particles 14, actuator 48 retracts plate 51 from brush 15. In some embodiments, plate 51 has a positive charge on surface 52. In some embodiments, plate 51 has a negative charge on surface 52.

In some embodiments, cleaning system 40 includes a second actuator with a second plate configured to attach to the second actuator. In some embodiments, the second plate has the same surface charge as plate 51. In some embodiments, the second plate has a different surface charge than plate 51. In some embodiments, cleaning system 40 is configured in such a manner that the second plate and plate 51 contact brush 15 simultaneously. In some embodiments, cleaning system 40 is configured in such a manner that the second plate and plate 51 contact brush 15 sequentially.

Figure 5:
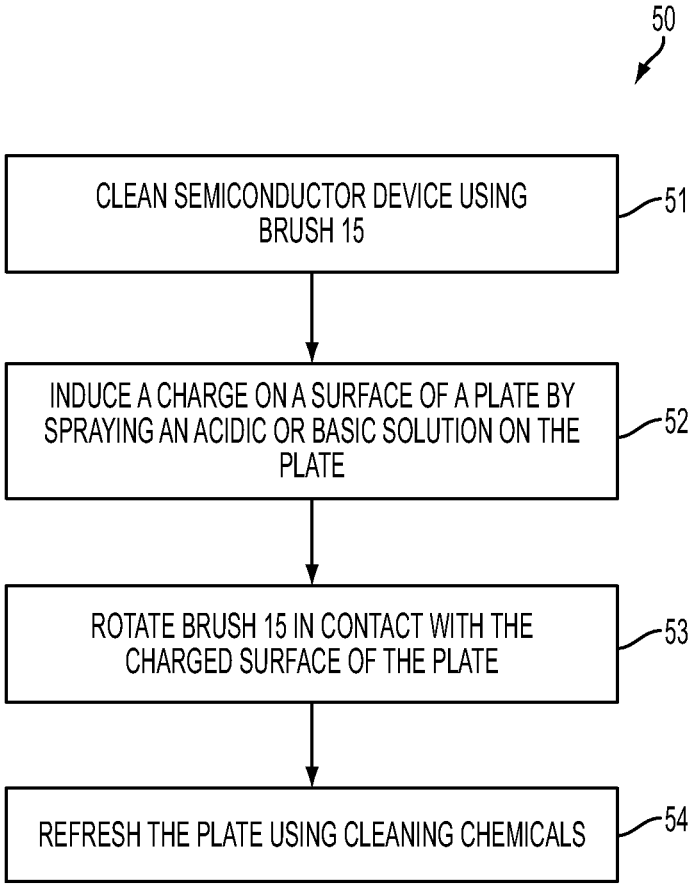
FIG. 5 is a flowchart for a method of cleaning a brush according to some embodiments.

FIG. 5 shows a method 50 of cleaning a brush 15 using a plate with a charged surface. Method 50 begins with step 51 in which the brush 15 cleans the surface of a semiconductor device. During the cleaning process abrasive particles and residue solution transfers from the semiconductor device to brush 15. After cleaning a semiconductor device, brush 15 must itself be cleaned to avoid transferring particles and residue solution onto subsequent semiconductor devices.

In step 52, a charge is induced on a surface of the plate by spraying the plate with a solution. The charged surface uses static electricity to attract oppositely charged particles from brush 15. The oppositely charged particles are thus removed with minimal mechanical force.

In step 53, brush 15 is brought into contact with the charged surface of the plate and brush 15 is rotated. The cleaning process in step 53 utilizes both static charge attraction as well as mechanical force to remove particles and residue solution from the brush. It was found by utilizing a cleaning plate with a charged surface the cleaning rate is between about 4,000 and about 5,000 particles a minute. In contrast, conventional cleaning using only mechanical force yields a cleaning rate of only about 100 particles per minute. By using a plate with a charged surface, it was found a brush can effectively clean between about 2,000 to about 2,500 wafers before being replaced. Using the conventional brush cleaning method, the brush needs to be replaced after cleaning about 1,000 wafers.

In step 54, the plate used to clean brush 15 is refreshed by cleaning chemicals. In an embodiment using a silicon nitride plate, the cleaning chemicals comprise phosphoric acid or another suitable cleaning solution. In an embodiment using a silicon oxide plate, the cleaning chemicals comprise hydrofluoric acid or another suitable cleaning solution.

One aspect of the description relates to a cleaning system for a brush using a plate having a silicon nitride or a silicon oxide and having a charge induced on a surface thereof and a machine to rotate the brush against the charged surface of the plate. Another aspect relates to a method of cleaning a brush by inducing a charge on the surface of a plate by spraying the plate with a solution, wherein the plate comprises a silicon nitride or a silicon oxide and the brush is rotated against the surface of the plate. A further aspect concerns a cleaning system for a brush having a plate comprising a silicon nitride having a positive charge on the surface thereof and a machine to rotate the brush against the positively charged surface of the silicon nitride plate.

What is claimed is:

1. A brush cleaning system comprising:

a first plate comprising at least one of silicon nitride ($Si_xN_y$) or silicon oxide ($Si_aO_b$), wherein the first plate has a static charge on a surface thereof wherein a, b, x and y are integers; and a machine configured to rotate a brush in contact with the static charged surface of the first plate.

2. The brush cleaning system of claim 1, wherein the first plate comprises $Si_xN_y$, where x and y are integers which range from one to five.

3. The brush cleaning system of claim 1, wherein the first plate comprises $Si_aO_b$, where a and b are integers which range from one to five.

4. The brush cleaning system of claim 1, wherein the static charge is a positive charge.

5. The brush cleaning system of claim 1, wherein the static charge is a negative charge.

6. The brush cleaning system of claim 1, further comprising:

a second plate comprising silicon nitride ($Si_xN_y$),wherein the second plate has a static charge on a surface thereof, the static charge on the surface of the second plate is different than the static charge on the surface of the first plate, and the machine configured to rotate the brush in contact with the static charged surface of the second plate.

7. The brush cleaning system of claim 6, wherein the brush is in contact with the first plate and the second plate simultaneously.

8. The brush cleaning system of claim 6, wherein the brush is in contact with only one of the first plate or the second plate at a time.

9. A brush cleaning system comprising:

a first plate comprising $Si_xN_y$, where x and y are integers, having a positive static charge on a surface thereof; and a machine configured to rotate a brush in contact with the positive static charge surface of the first plate.

10. The brush cleaning system of claim 9, further comprising:

a second plate comprising silicon oxide having a negative static charge on a surface thereof, and the machine configured to rotate the brush in contact with the negative static charge surface of the second plate, wherein the brush contacts the first plate and the second plate simultaneously.

11. The brush cleaning system of claim 9, further comprising:

a second plate comprising silicon oxide having a negative static charge on a surface thereof, and the machine configured to rotate the brush in contact with the negative static charge surface of the second plate, wherein the brush contacts only one of the first plate and the second plate at a time.

12. A brush cleaning system comprising:

a first plate comprising at least one of silicon nitride ($Si_xN_y$) or silicon oxide ($Si_aO_b$), wherein a, b, x and y are integers and the first plate has a first static charge on a surface thereof;

a second plate comprising at least one of silicon nitride or silicon oxide, wherein the second plate has a second static charge on a surface thereof; and a machine configured to rotate a brush in contact with at least one of the static charged surface of the first plate or the static charged surface of the second plate.

13. The brush cleaning system of claim 12, wherein the first static charge is opposite the second static charge.

14. The brush cleaning system of claim 12, wherein at least one of the static charged surface of the first plate or the static charged surface of the second plate has a basic solution thereon.

15. The brush cleaning system of claim 14, wherein the basic solution comprises tetramethylammonium hydroxide (TMAH).

16. The brush cleaning system of claim 12, wherein at least one of the static charged surface of the first plate or the static charged surface of the second plate has an acidic solution thereon.

17. The brush cleaning system of claim 16, wherein the acidic solution comprises citric acid or phosphoric acid.

18. The brush cleaning system of claim 12, wherein the machine is configured to rotate the brush in contact with both the static charged surface of the first plate and the static charged surface of the second plate.

19. The brush cleaning system of claim 12, wherein the static charged surface of the first plate has a same charge as the static charged surface of the second plate.

20. The brush cleaning system of claim 12, wherein the static charged surface of the first plate is positively charged.

* * * * *